US007173644B2

(12) United States Patent
Takakura

(10) Patent No.: US 7,173,644 B2
(45) Date of Patent: Feb. 6, 2007

(54) OPTICAL PRINTHEAD AND IMAGE FORMING APPARATUS

(75) Inventor: Toshihiko Takakura, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 241 days.

(21) Appl. No.: 10/786,575

(22) Filed: Feb. 23, 2004

(65) Prior Publication Data

US 2005/0062840 A1 Mar. 24, 2005

(30) Foreign Application Priority Data

Feb. 28, 2003 (JP) ..... 2003-052582

(51) Int. Cl.
*B41J 15/14* (2006.01)
*B41J 27/00* (2006.01)

(52) U.S. Cl. ..... 347/241; 347/242

(58) Field of Classification Search ..... 347/241–242; 396/30; 385/115, 119
See application file for complete search history.

(56) References Cited

U.S. PATENT DOCUMENTS 5,011,271 A * 4/1991 Saito et al. ..... 359/259
5,816,677 A * 10/1998 Kurematsu et al. ..... 362/609
6,281,923 B1 8/2001 Yamada et al.
6,479,942 B2 * 11/2002 Kimura ..... 315/169.3
6,750,979 B1 * 6/2004 Kobayashi et al. ..... 358/1.14
2001/0033744 A1 * 10/2001 Ohmura et al ..... 396/30
2002/0060732 A1 5/2002 Miyagawa et al.

FOREIGN PATENT DOCUMENTS

JP 6-202242 7/1994
JP 2000-280527 10/2000

* cited by examiner

*Primary Examiner*—Manish S. Shah
*Assistant Examiner*—Han Samuel Choi
(74) *Attorney, Agent, or Firm*—Hamre, Schumann, Mueller & Larson, P.C.

(57) ABSTRACT

An optical printhead includes a light source, a light guide, and a light collecting sheet. The light guide includes a light incident surface facing the light source and a flat light emitting surface extending in a primary scanning direction. The light collecting sheet faces the light emitting surface of the light guide and allows the passage of light emitted from the light emitting surface. The collecting sheet includes a prism layer formed with a plurality of ridges extending parallel to each other, and a base layer laminated on the prism layer. Diffused light rays emitted from the light emitting surface of the light guide pass through the light collecting sheet to become parallel rays.

11 Claims, 12 Drawing Sheets

OPTICAL PRINTHEAD AND IMAGE FORMING APPARATUS

BACKGROUND OF THE INVENTION

1. Field of the Invention

The present invention relates to an optical printhead used for forming images on a photosensitive recording medium. The present invention further relates to an image forming apparatus including an optical printhead.

2. Description of the Related Art

Recently, digital cameras are more popular than film cameras. As is known, digital cameras are provided with recording medium such as flash memories, so that images are stored in the recording medium as digital data. Such stored digital data is sent to an inkjet printer or thermal-transfer printer to be printed on plain paper. Alternatively, an optical printhead is used to form images on photosensitive films based on the stored digital data. Digital cameras provided with a compact optical print head are also commercially available. With such arrangements, images can be formed on photosensitive films on the spot.

An example of conventional optical printhead is disclosed in JP-A-2000-280527. The printhead shown in the application includes a light source and a liquid crystal shutter. The light source generates linear light extending in a primary scanning direction. The liquid crystal shutter selectively transmits the linear light to illuminate a photosensitive film. The light source includes one or more light-emitting diodes and a transparent light guide. Light emitted from the light-emitting diode is changed to a line of illuminating light by the light guide.

The conventional optical printhead has the following problem. The light from the light-emitting diode undergoes repeated total reflection before emitted out from a light emitting area of the light guide. Thus, the emitted light tends to diffuse while traveling. As a result, only part of the light, emitted from the light emitting area of the light guide, can reach a predetermined linear area on the liquid crystal shutter. In other words, the light from the light-emitting diode cannot be put to efficient use.

SUMMARY OF THE INVENTION

The present invention has been proposed under the above-described circumstances. It is, therefore, an object of the present invention to provide an optical printhead with which light generated by a light source can be used efficiently. Another object of the present invention is to provide an image forming apparatus incorporating such an optical printhead.

According to a first aspect of the present invention, there is provided an optical printhead comprising: a light source; a light guide including a light incident surface facing the light source and a flat light emitting surface extending in a primary scanning direction; and a light collecting layer facing the light emitting surface and transmitting light emitted from the light emitting surface. The light collecting layer causes diffused light from the light emitting surface to be collected in a normal direction of the light emitting surface.

Preferably, the light guide may include a counter surface which extends in the primary scanning direction and arranged opposite to the light emitting surface. The counter surface is provided with a plurality of inclined portions for reflecting light traveling in the light guide so that the light is directed toward the light emitting surface.

Preferably, the optical printhead of the present invention may comprise a mirror reflector covering the counter surface.

Preferably, the light collecting layer may comprise a first prism layer provided with a plurality of ridges extending parallel to each other.

Preferably, each of the ridges may include a triangular section.

Preferably, each of the ridges may extend parallel to the primary scanning direction.

Preferably, the optical printhead of the present invention may further comprise a second prism layer cooperating with the first prism layer for collecting light. The second prism layer is provided with a plurality of ridges extending parallel to each other. Each of the ridges of the second prism layer extends across the ridges of the first prism layer.

Preferably, each of the ridges of the second prism layer may include a triangular section.

Preferably, the optical printhead of the present invention may further comprise a liquid crystal shutter facing the light emitting surface of the light guide via the light collecting layer. The liquid crystal shutter comprises a plurality of shutter portions arranged in a row extending in the primary scanning direction.

According to a second aspect of the present invention, there is provided an image forming apparatus. The image forming apparatus may comprise an optical printhead as described above, and a photosensitive recording medium irradiated by the optical printhead.

Other features and advantages of the present invention will be apparent from following description of preferable embodiment.

DETAILED DESCRIPTION OF THE PREFERRED EMBODIMENTS

A preferred embodiment of the present invention is described below with reference to the accompanying drawings.

FIGS. 1–9 illustrate an image forming apparatus X according to the present invention.

Figure 1:
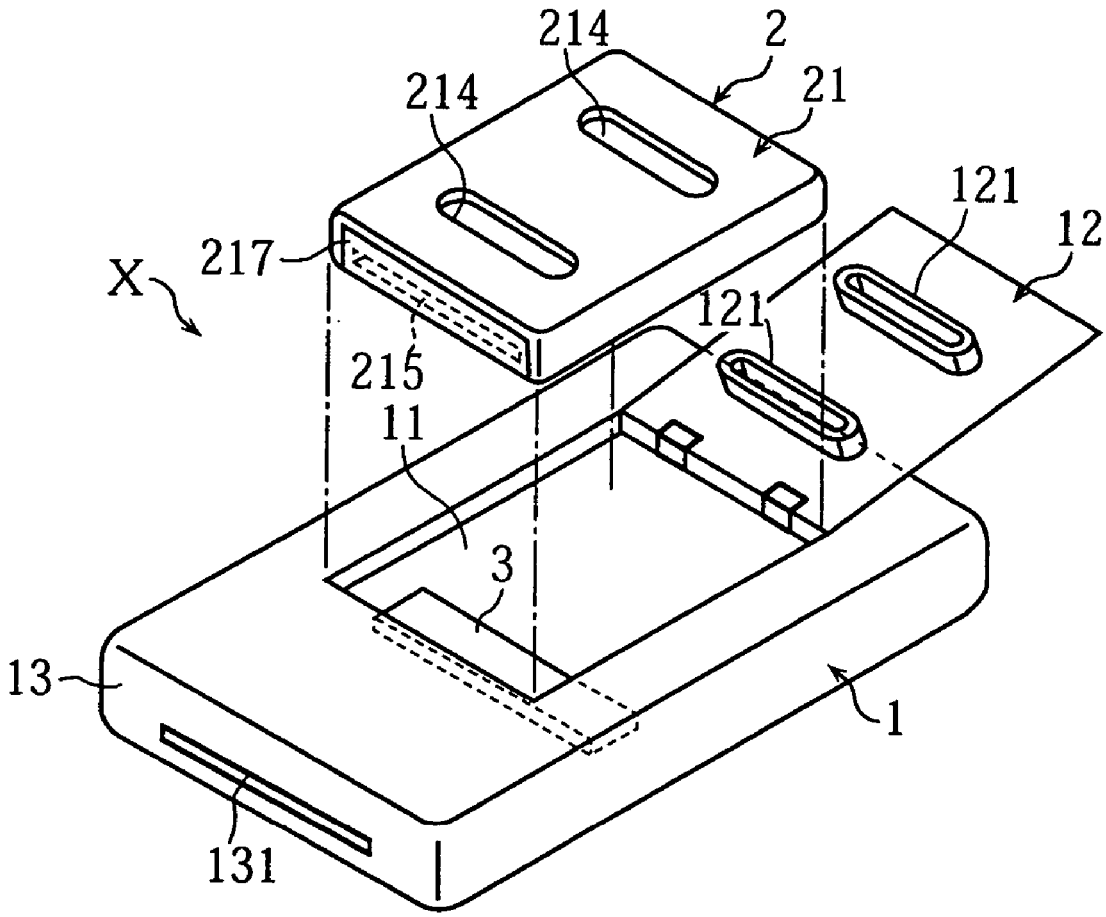
FIG. 1 is a perspective view illustrating an image forming apparatus according to the present invention.
Figure 2:
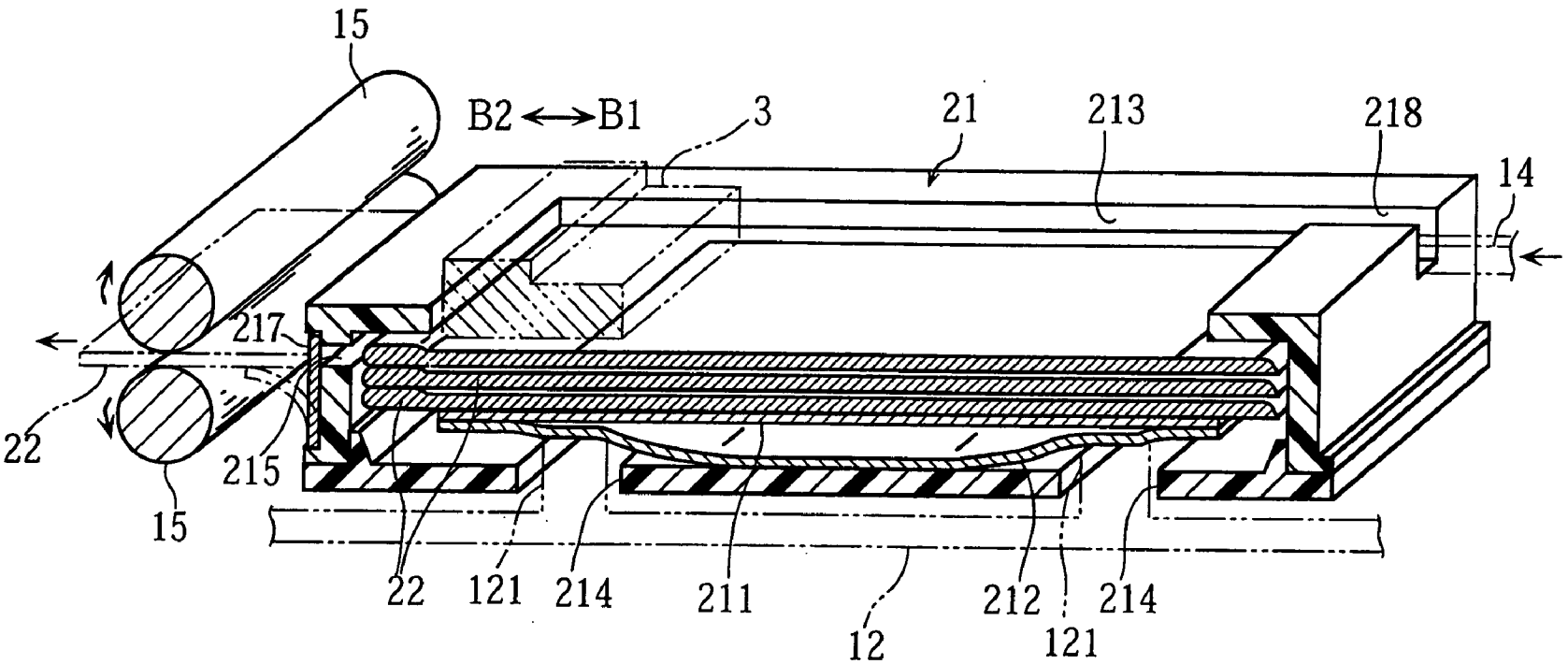
FIG. 2 is a sectional view illustrating a principal part of the image forming apparatus.

As shown in FIGS. 1–2, the image forming apparatus X includes a housing 1, a film pack 2, and an optical printhead 3.

As shown in FIG. 1, the housing 1 is formed with a rectangular opening 11, and this opening 11 can be opened or closed by a lid 12. The lid 12 is provided with a pair of pressing portions 121. The housing 1 includes an end surface 13 which is formed with a slit 131.

The film pack 2 includes a case 21 and photosensitive films (see reference number 22 in FIG. 2) contained in the case. The case 21 includes an outer surface (the upper surface in FIG. 1) and an inner surface (the lower surface in FIG. 1) opposite to the outer surface. As shown in FIG. 1, the outer surface is formed with a pair of inlets 214 for insertion of the paired pressing portions. On the other hand, though not shown in FIG. 1, the inner surface is formed with a rectangular opening (see reference number 213 in FIG. 2). It should be noted that the film pack 2 in FIG. 2 is an upside-down image of the one in FIG. 1.

As shown in FIG. 2, the case 21 of the film pack 2 contains a plurality of photosensitive films 22 which are placed on a flat supporting plate 211. The supporting plate 211 is supported by a leaf spring 212. When the film pack 2 is put into the housing 1 and the lid 12 is closed, the pressing portions 121 pass through the insertion inlets 214 to press the leaf spring 212 upwardly (toward the opening 213), as indicated by phantom lines in FIG. 2. As a result, the supporting plate 211 and films 22 are upwardly pressed by the leaf spring 212, whereby the film 22 at the top constantly contacts the peripheral area of the opening 213.

The printhead 3, placed in the opening 213 of the case 21, is movable in the B1 and B2 directions.

The case 21 includes an end (the left side end in FIG. 2) formed with a long slit 215 which extends horizontally. The topmost film 22 can be discharged from the case 21 via the slit 215. The slit 215 is covered by a flexible shielding member 217 for preventing the entry of dust into the case 21. The film 22 discharged from the case 21 is consequently discharged out of the housing 1 via the slit 131 (see FIG. 1) formed at the end of the housing 1.

Figure 3:
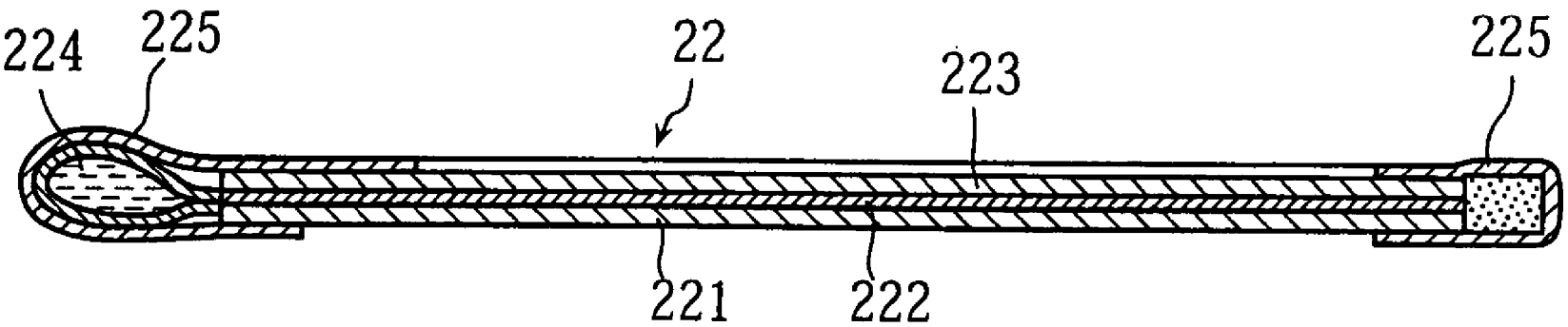
FIG. 3 is a sectional view illustrating a photosensitive film.

FIG. 3 illustrates the inner structure of the photosensitive film 22. The film 22 includes laminate structure formed of a rectangular base 221, a photosensitive layer 222, and a transparent cover 223. The film 22 further includes a front end (the left side end in FIG. 3) which holds a developer pack 224. Reference number 225 indicates an adhesive sheet. The adhesive sheet 225 is attached for covering the peripheral end of a lamination formed of the base 221, the photosensitive layer 222, and the transparent cover 223, thereby holding these layers together.

As shown in FIG. 2, the housing 1 is internally provided with a pushing bar 14 and upper and lower platen rollers 15. The pushing bar 14 is moveable in the B1 and the B2 directions in FIG. 2 via a cutout 218 formed in the case 21. Due to the movement of the pushing bar 14 in the direction B2, the photosensitive film 22 is pushed out of the film pack 2. The platen rollers 15 serve to draw the photosensitive film 22 out of the film pack 2 and then to discharge the film 22 out of the slit 131 of the housing 1. The platen rollers 15 apply pressure from upside and downside to the photosensitive film 22 so that the developer pack 224 (see FIG. 3) breaks to leak out the developing fluid. The platen rollers 15 also serve to spread the leaked developing fluid all over the photosensitive film 22.

Figure 4:
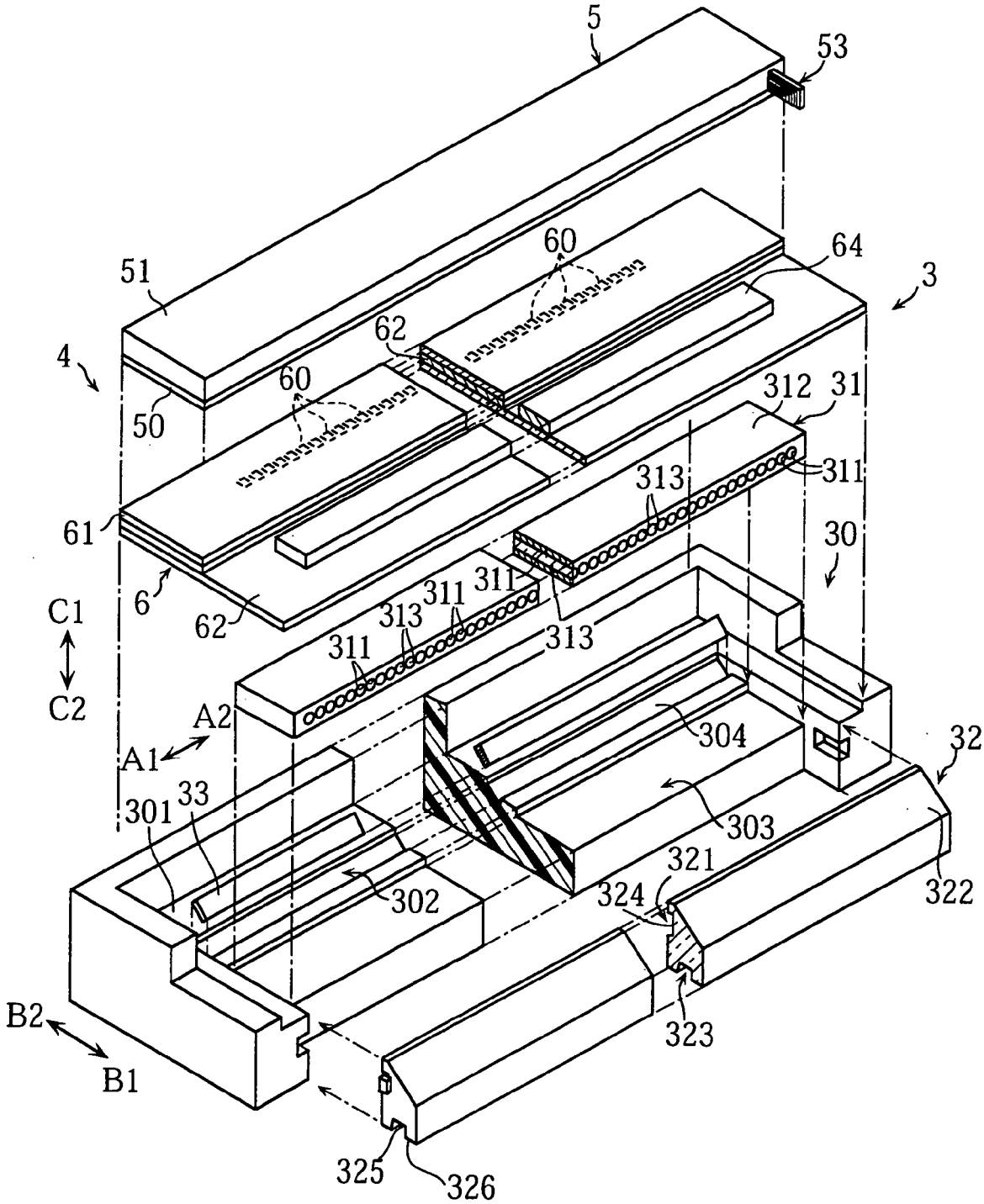
FIG. 4 is an exploded perspective view of an optical printhead used for the image forming apparatus.
Figure 5:
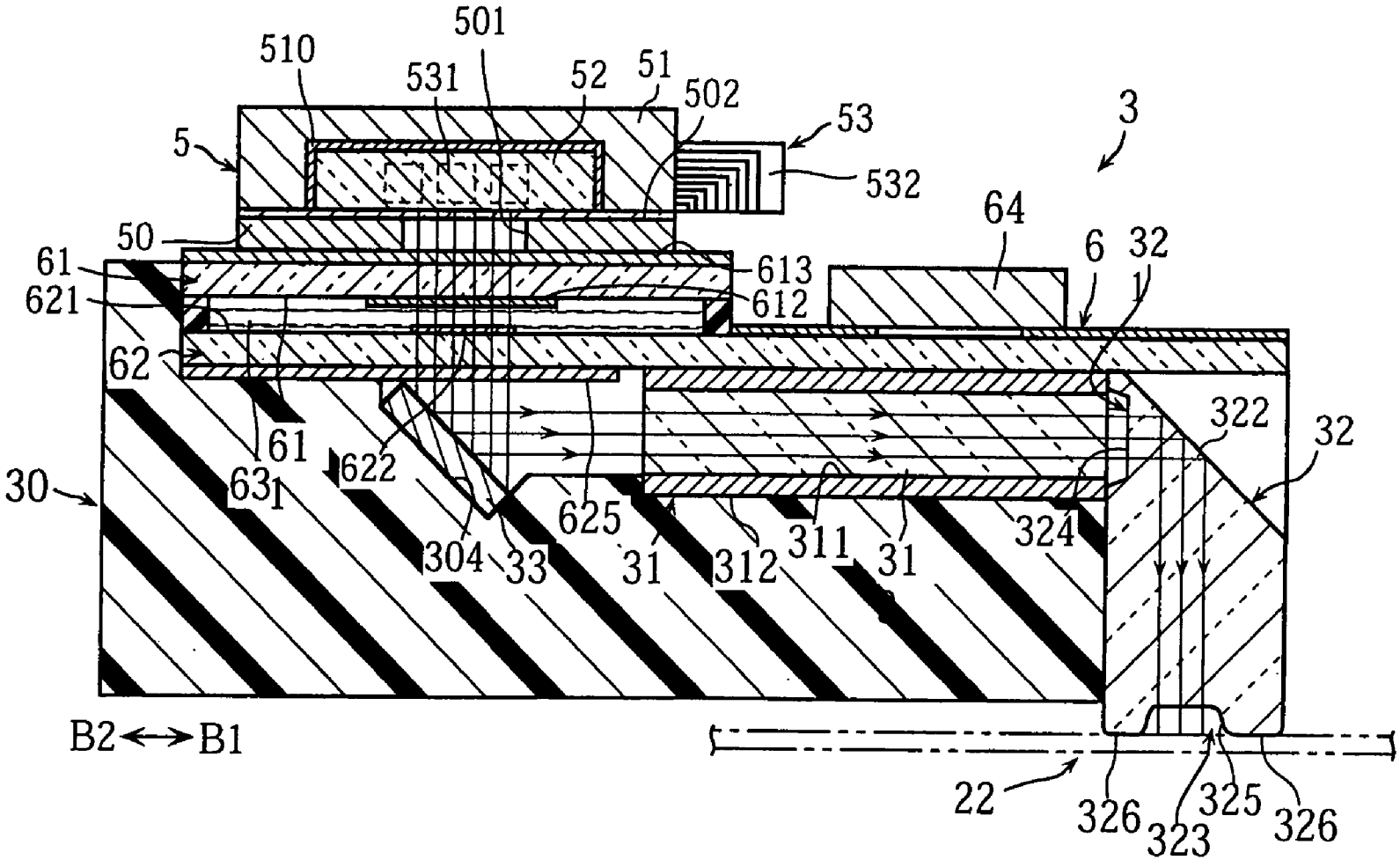
FIG. 5 is a sectional view illustrating a principal part of the optical printhead.

As shown in FIGS. 4–5, the printhead 3 includes a frame 30 for holding an illuminator 5, a liquid crystal shutter 6, a rod lens array 31, and a prism 32.

The frame 30 includes an L-shaped mounting portion 301 as viewed in section, a first holding portion 302 and a second holding portion 303, both extending in the A1–A2 direction (the primary scanning direction) in FIG. 4. The mounting portion 301 supports the liquid crystal shutter 6, upon which the illuminator 5 is mounted.

The first holding portion 302 includes an inclined surface 304 which inclines relative to a horizontal plane by 45 degrees. The inclined surface 304 supports a reflecting member 33 contacting the surface. Preferably, the reflecting member 33 has a mirror surface. The reflecting member 33 is made of aluminum, for example.

The second holding portion 303 holds the rod lens array 31 sandwiched by the frame 30 and the liquid crystal shutter 6. The rod lens array 31 includes a holder 312 formed with a plurality of through-holes 311, and rod lenses 313 held in the through-holes 311. The rod lenses 313 are arranged in the primary scanning direction, and their axes extend in the secondary scanning direction.

The frame 30 is open, at one side thereof, to the secondary scanning direction B1 (see FIG. 4), the prism 32 being fixed to this open side. The prism 32 includes a light incident surface 321, a light reflecting surface 322, and a light emitting surface 323 (see FIG. 5). The light enters the prism 32 through the light incident surface 321 and then reflects on the light reflecting surface 322 to change its traveling direction by 90 degrees, thereby exiting out through the light emitting surface 323. The prism 32 is made of e.g. transparent glass or acrylic resin.

The light incident surface 321 is formed with a concave portion 324 extending in the primary scanning direction. The concave portion 324 prevents the prism 32 from contacting the rod lenses 313, so that the rod lenses 313 are saved from damage. The light emitting surface 323 is formed with a concave portion 325 and protrusions 326 extending in the primary scanning portion. The convex portions 326 project in the thickness direction of the frame 30 (downward in FIG. 5). When the printhead 3 moves relative to the photosensitive film 22, only the protrusions 326 come into contact with the photosensitive film 22. This structure contributes to reduction of contact area and contact resistance between the printhead 3 and the photosensitive film 22. As a result, the photosensitive film 22 is saved from damage, and the printhead 3 can move smoothly over the photosensitive film 22. Further, as the light emitting area of the prism 32 (in the concave portion 325) is saved from being damaged by the film 22, light irradiation to the film 22 is performed properly.

Figure 6:
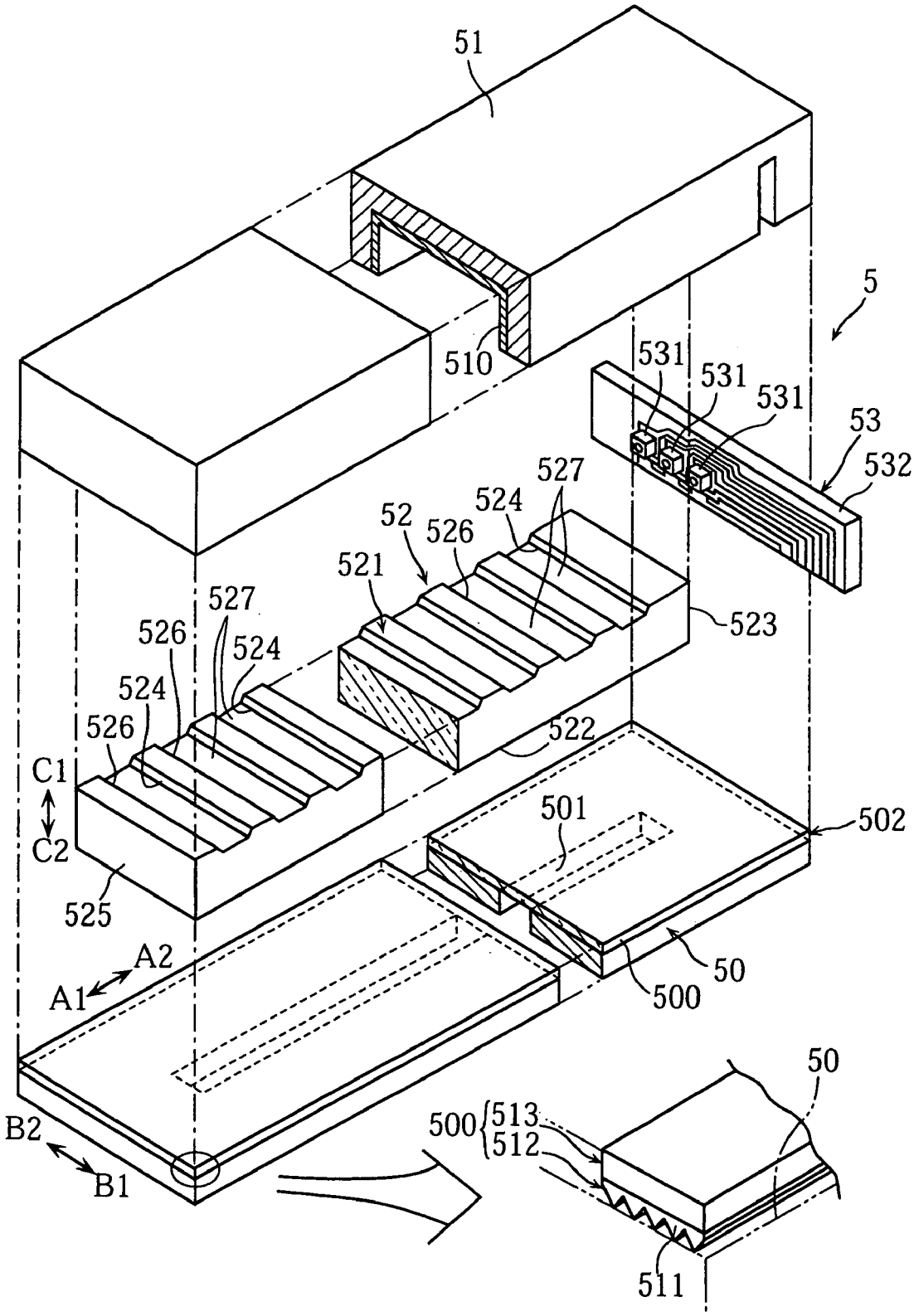
FIG. 6 is an exploded perspective view of an illuminator used for the optical printhead.

As shown in FIG. 6, the illuminator 5 includes a flat first light shield 50 and a second light shield 51 in the form of a downwardly open box. The first light shield 50 and second light shield 51 form a space in which a light guide 52 and a light source unit 53 are accommodated.

As shown in FIG. 6, the light guide 52 is in the form of a substantially rectangular solid as a whole, and elongated in the primary scanning direction. The light guide 52 may be made of e.g. an acrylic transparent resin such as PMMA, or other light permeable material. All surfaces of the light guide 52 are mirror surfaces, whereby light traveling in the light guide 52 is reflected totally by the surfaces of the light guide 52 or passes through the surfaces. Specifically, when the light enters at an angle larger than the critical angle of total reflection relative to the light guide surfaces, the light is totally reflected. On the other hand, when the incident angle is smaller than the critical angle of total reflection, the light passes through the light guide surfaces.

Figure 7A:
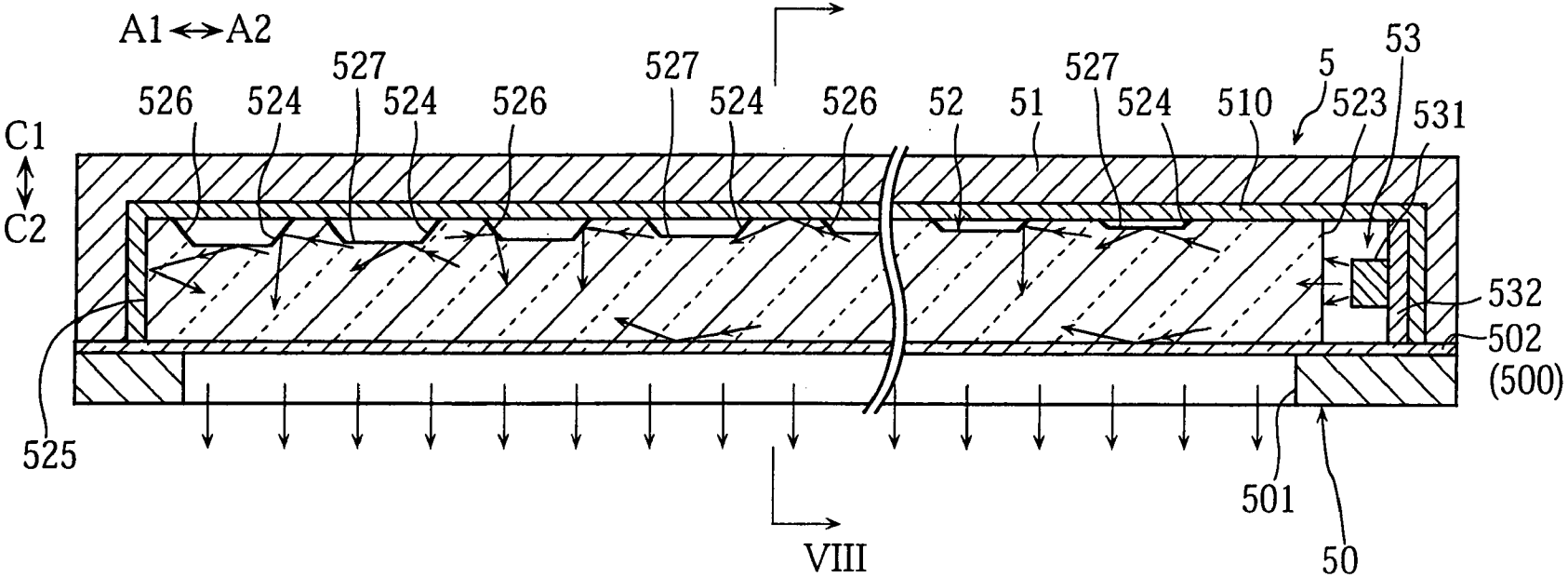
FIG. 7A is a sectional view showing a principal part of the illuminator.

The light guide 52 includes a light incident surface 523 at a lengthwise end (facing the light source unit 53). Further, the light guide 52 includes upper and lower surfaces extending lengthwise (spaced to each other in the C1–C2 direction) and two side surfaces (spaced to each other in B1–B2 direction) extending between the upper and lower surfaces. As shown in FIG. 7A, light entered from the light incident surface 523 is reflected by the above-described four surfaces, as traveling in the primary scanning direction. The lower surface of the light guide 52 serves as a flat light emitting surface 522 for emitting light toward the liquid crystal shutter 6. The light emitting surface 522 faces the liquid crystal shutter 6 through a light collecting means 502.

Figure 7B:
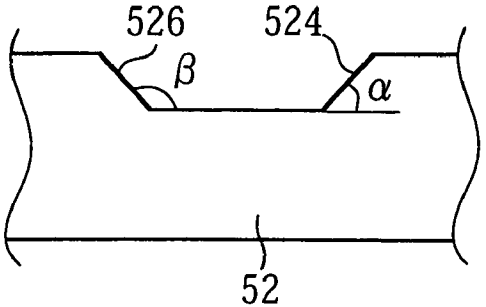
FIG. 7B is a view illustrating a principal part of the light guide used for the illuminator.

The upper surface (reference number 521 in FIG. 6) of the light guide 52 is provided with a reflecting means for reflecting light traveling in the light guide 52, toward the light emitting surface 521. Specifically, as shown in FIGS. 6 and 7A, the upper surface of the light guide 52 is formed with a plurality of grooves 527 extending in the secondary scanning direction in parallel to each other. A pitch between each two adjacent grooves is 200 μm, for example. The depths of the grooves are in the range of e.g. 0.3 μm–0.9 μm, and they become shallower as proceeding from the left to the right in FIG. 7A. Each of the grooves 527 is formed with a first inclined surface 524 and a second inclined surface 526. The first inclined surface 524 is nearer to the light incident surface 523 than the second inclined surface 526 is. As shown in FIG. 7B, the inclination angle $\alpha$ of the first inclined surface 524 satisfies $0° < \alpha < 90°$ and the inclination angle $\beta$ of the second inclined surface 526 satisfies $90° < \alpha < 180°$. In the illustrated example, the angle $\alpha$ is about 45°, while the angle $\beta$ is about 135° (=180°−45°).

As shown in FIG. 7A, the first inclined surface 524 reflects light traveling from the light incident surface 523 toward the opposite end 525, so that the reflected light is directed toward the light emitting surface 522. On the other hand, the second inclined surface 526 reflects light traveling from the end 525 toward the light incident surface 523, so that the reflected light is directed toward the light emitting surface 522.

The first light shield 50 and the second light shield 51 prevent leakage of light emitted from the light source unit 5, while also preventing entry of outside light into the light guide 52. The first light shield 50 covers the light emitting surface 522. The first light shield 50 is formed an opening 501 extending longitudinally in the primary scanning direction. The second light shield 51 provides an internal space for accommodating the light guide 52. The first and second light shields 50, 51 are made of e.g. black-colored PC or PMMA. It should be noted, however, that the inner surface of the first light shield 50 is of highly reflective color such as white. The inner surfaces of the second light shield 51 are covered with mirror reflectors 510 facing the light guide 52. The mirror reflector 510 may be provided by fixing an optical sheet, which has a specular surface, to the inner surface of the second light shield 51. It is possible that the mirror reflector 510 may be provided only on an inner area of the second light shield 51, the area facing the upper surface 521 of the light guide 52.

Figure 8A:
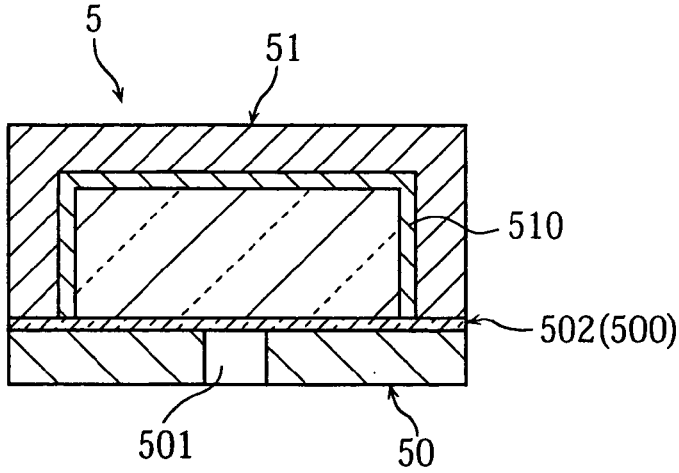
FIG. 8A is a sectional view taken along lines VIII—VIII in FIG. 7A.
Figure 8B:
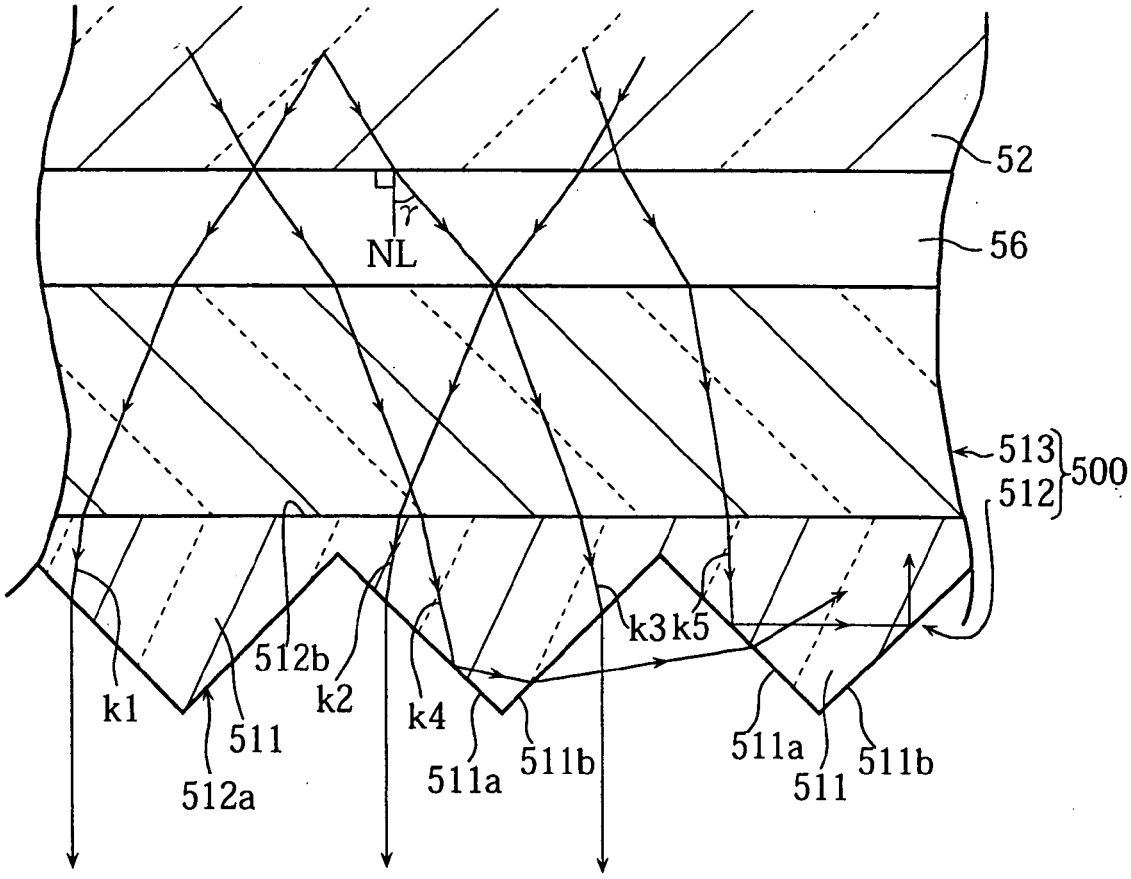
FIG. 8B is a view illustrating a principal part of a luminance improving sheet used for the illuminator.

The light collecting means 502 is attached to the inner surface of the first light shield 50. As shown in FIGS. 8A–8B (and FIG. 6), in the present embodiment, the light collecting means 502 comprises a luminance improving sheet 500. A very thin air layer 56 exists between the light guide 52 and the luminance improving sheet 500. The luminance improving sheet 500 collects the emitted light (diffused light) from the light guide 52 into a predetermined direction. Specifically, a light ray indicated as k3 in FIG. 8B is taken as an example. Immediately after emitted from the lower surface (light emitting surface) of the light guide 52, the light ray k3 travels in a direction inclined at an angle $\gamma$ (>>0°) relative to the normal line NL of the emitting surface. However, the light ray k3 is changed in its traveling course by passing through the luminance improving sheet 500, and thus travels in a direction substantially parallel to the normal line NL. In other words, the inclination angle of the light ray k3 relative to the normal line NL becomes smaller as the ray k3 passes through the luminance improving sheet 500.

In order to collect light as described above, the luminance improving sheet 500 has the following structure. As shown in FIG. 8B, the luminance improving sheet 500 includes a prism layer 512 and a base layer 513. The prism layer 512 includes an under surface 511 which is formed with a plurality of parallel ridges 511 each extending in the primary scanning direction. The ridges 511 are arranged at a pitch of about 50–100 μm, for example. Each of the ridges 511 includes two inclined surfaces 511*a* and 511*b*, which form is osceles triangles in section. The inclined surfaces 511*a* and 511*b* meet at 90°, for example. The prism layer 512 further includes a flat upper surface 512*b*. The prism layer 512 may be made of e.g. acrylic transparent resin. In the present invention, the section of the ridges 511 is not limited to an isosceles triangle. The ridges 511 may be semicircular in section, for example. The base layer 513 includes flat upper and lower surfaces. The base layer 513 may be made of e.g. polyester transparent resin. The base layer 513 has a thickness of 100 μm, for example.

The function of the luminance improving sheet 500 is described below. The light emitted from the lower surface of the light guide 52 is diffused light, and generally this light travels in various directions (light rays k1–k5 are illustrated in FIG. 8B). Each of the light rays is refracted toward the normal direction (direction parallel to the normal line NL) when entering the base layer 513 of the luminance improving sheet 500, and further refracted toward the normal direction when entering the prism layer 512. In this manner, the diffusing angle (the angle relative to the normal direction) of each light ray becomes smaller.

As seen from the light rays K1–k3 shown in FIG. 8B, most of the light rays, after having entered the prism layer 512, enter the inclined surface 511*a* or 511*b* of the ridges 511 at a relatively small incident angle. As a result, these light rays pass through the inclined surfaces to exit to the outside. At this time, each of the light rays is refracted so that its traveling direction comes closer to the normal line (ideally, the traveling direction of the light ray becomes substantially parallel to the normal line).

After having entered the prism layer 512, some of the light rays may enter the inclined surface 511*a* or 511*b* of the ridges 511 at a relatively great incident angle, like the light rays k4 and k5 shown in FIG. 8B. The light ray k4 is reflected by the left inclined surface 511*a* of one of the ridges 511, and then passes through the right inclined surface 511*b* to temporarily exit out of the prism layer 512. Thereafter, the light ray k4 enters the adjacent right-side ridge 511, to go back into the luminance improving sheet 500. On the other hand, the light ray k5 is reflected to the right by the left inclined surface 511*a* of one ridge 511 and further reflected upward by the right inclined surface 511*b* of the same ridge 511.

Then, the light rays k4 and k5 go back into the light guide 52 through the base layer 513 and the air layer 56. Such light ray having returned to the light guide 52 is repeatedly reflected by the surfaces of the light guide 52 to travel in the primary scanning direction, thereby being emitted from the light emitting surface 522 of the light guide 52 toward the luminance improving sheet 500 again. In this manner, it is possible to equalize the emitting of light from the light emitting surface 522 of the light guide 52.

As shown in FIG. 6, the light source unit 53 includes three light-emitting diodes 531 and an insulating substrate 532 for mounting the light-emitting diodes. The light-emitting diodes 531 are red, green, and blue light-emitting diodes, each of which can be driven individually.

As shown in FIG. 4, the liquid crystal shutter 6 includes a plurality of shutter portions 60 aligned in the primary scanning direction, and each of the shutter portions 60 can be driven actively. As shown in FIG. 5, the liquid crystal shutter 6 further includes a pair of transparent plates 61 and 62 as well as a liquid crystal 63 filled between the plates. The liquid crystal 62 may be an antiferroelectric liquid crystal. Antiferroelectric liquid crystal can change the current direction of its spontaneous polarization quickly in response to the change of the applied voltage. Due to this property, the application of the antiferroelectric liquid crystal to the liquid crystal shutter 6 enables the shutter portions 60 to open and close with quick response, thereby facilitating high-speed printing.

Figure 9:
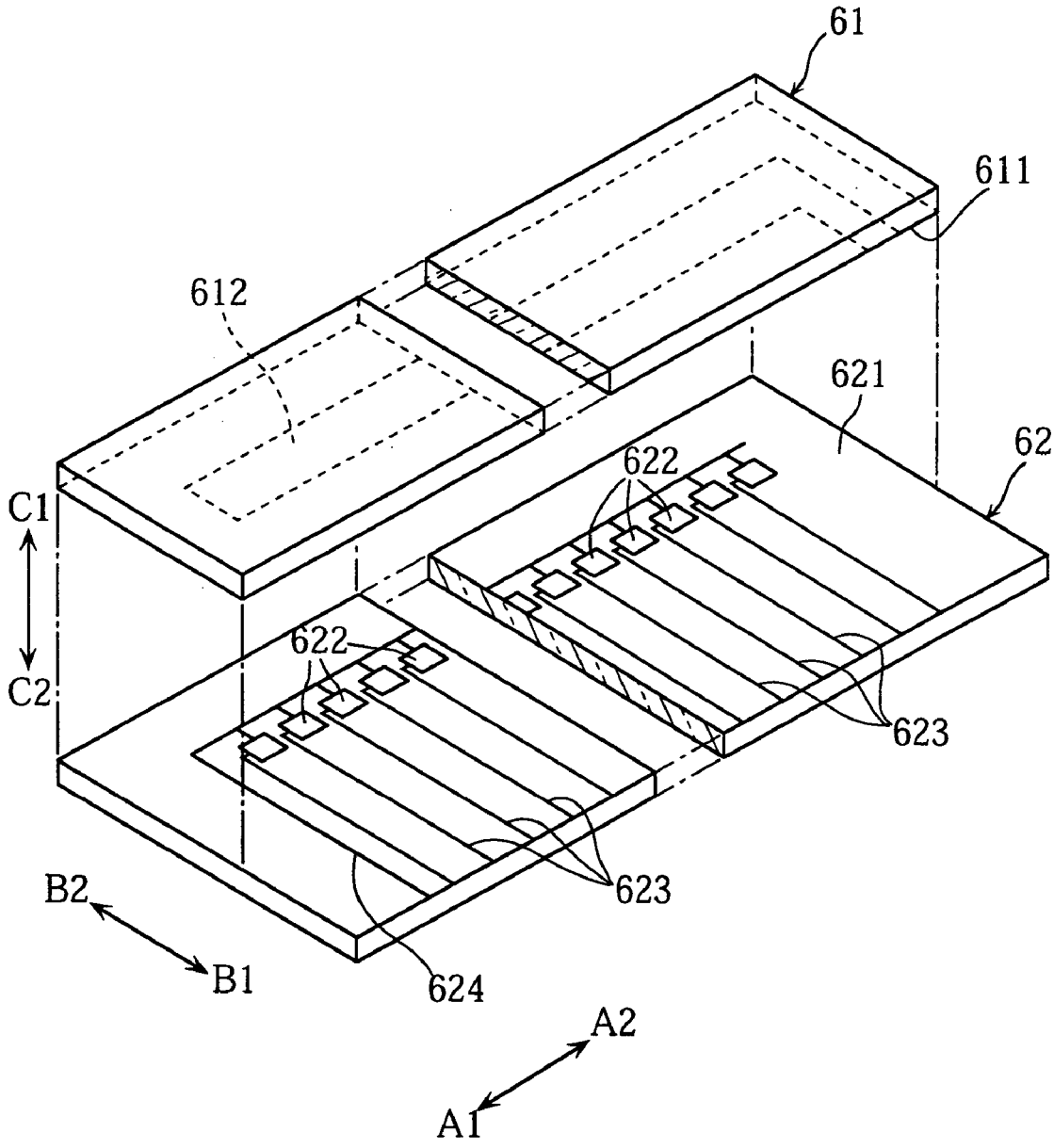
FIG. 9 is a perspective view illustrating a principal part of a liquid crystal shutter used for the optical printhead.

As shown in FIG. 9, the transparent plate 62 includes an inner surface 621 formed with a plurality of individual electrodes 622 aligned in the primary scanning direction. Each of the individual electrodes 622 is connected to a source line 623 via a first active element (not shown) such as TFT, while also connected to a gate line 624 via a second active element (not shown). The second active element is driven through the gate line 624 to selectively connect each of the individual electrodes 622 to the corresponding source line 623.

The transparent plate 61 includes an inner surface 61 formed with a common electrode 612 connected to the ground. The common electrode 612 faces each of the individual electrodes 622, and this portion provides one shutter element 60. A prescribed potential difference is applied to each shutter element 60 when the second active element is switched on through the gate line 624. The electrical potential difference can be adjusted by selecting the voltage value which is applied through the source line 623. On the other hand, when the second active element is turned off, the applied electrical potential difference is maintained.

As shown in FIG. 5, the transparent plates 61 and 62 further include outer surfaces provided with polarizers 613 and 625, respectively. The polarizers 613, 625 are so arranged that the respective polarization axes extend perpendicularly to each other. Therefore, the light passing through the polarizer 613 and through the liquid crystal 63 changes its polarization direction at the shutter portions 60 to which a voltage no smaller than a threshold is applied, so that the light can pass through the polarizer 625. In this state, the light transmittance at the shutter portion 60 can be adjusted by changing the electrical potential difference applied across the individual electrodes 622 and the common electrode 612. On the other hand, the polarization direction of the light does not change at the shutter portion 60 to which a voltage smaller than the threshold is applied, so that the light cannot pass through the polarizer 625.

As shown in FIG. 5, a drive IC 64 is mounted on the transparent plate 62. The drive IC 64 is connected to the gate line 624, source line 623, and common electrode 612 of the liquid crystal shutter 6 for allowing/prohibiting the passage of light and controlling the transmittance. The drive IC is further connected to the light-emitting diodes 531 to switch on/off the light-emitting diodes 531.

The image forming apparatus X produces an image on a photosensitive film 22 by irradiating the photo sensitive layer 222 (see FIG. 3) with the printhead 3, and then developing it.

The light exposure of the photosensitive layer 222 is performed by irradiating the photosensitive film 22 successively with linear red, green and blue light from the printhead 3. The illumination of linear light is repeatedly performed by moving the printhead 3 step-by-step in the secondary scanning direction.

More specifically, the light emitted from the light-emitting diodes 531 is introduced into the light guide 52 through the light incident surface 523. The light undergoes repeated total reflection at the four surfaces in the light guide 52, including the light emitting surface 522 and the upper surface 521, and travels in the primary scanning direction (see FIG. 7A). Then, when striking on the first or second inclined surface 524, 526, the light is totally reflected by the surface to travel toward the light emitting surface 522.

In the light guide 52, there are some light rays which travel at an angle smaller than the total reflection critical angle toward the other surfaces than the light emitting surface 522. Such light rays are reflected by the mirror reflector 510 to return into the light guide 52.

The light rays emitted from the light emitting surface 522 enter the light collecting means 502 (luminance improving sheet 500), pass through it, and are emitted from the illuminator 5 via the opening 501 of the first light shield 50. After emitted through the opening 501, the light is irradiated onto the photosensitive film 22 through the liquid crystal shutter 6, the rod lens array 31, and the prism 32 (see FIG. 5). As described above, the light collecting means 502 collects the emitted light rays (diffused light rays) from the light emitting surface 522 to make them almost parallel light rays. In this manner, the light rays emitted from the light emitting surface 522 of the light guide 52 are efficiently directed to the photosensitive film 22.

The inner surface of the first light shield 50 is provided with a highly reflective color. With this arrangement, light rays which fail to pass through the opening 501 of the first light shield 50, are reflected by the inner surface of the first light shield 50 to return back into the light guide 52. In place of this arrangement, a mirror reflector may be provided between the first light shield 50 and the light collecting means 502. As easily seen, this reflector is formed with an opening corresponding to the opening 501.

Figure 10:
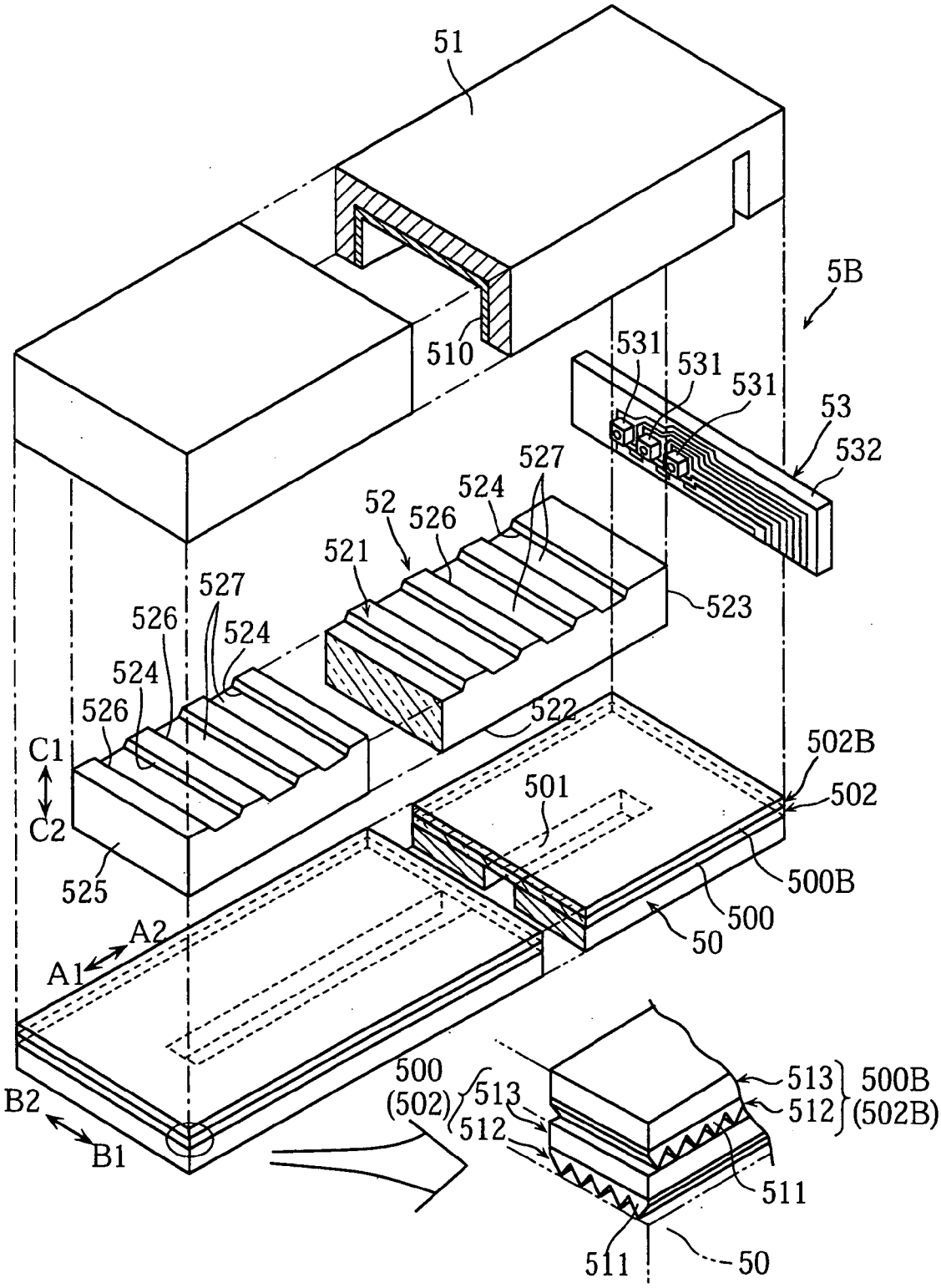
FIG. 10 is an exploded perspective view illustrating another example of illuminator used for the optical printhead.
Figure 11:
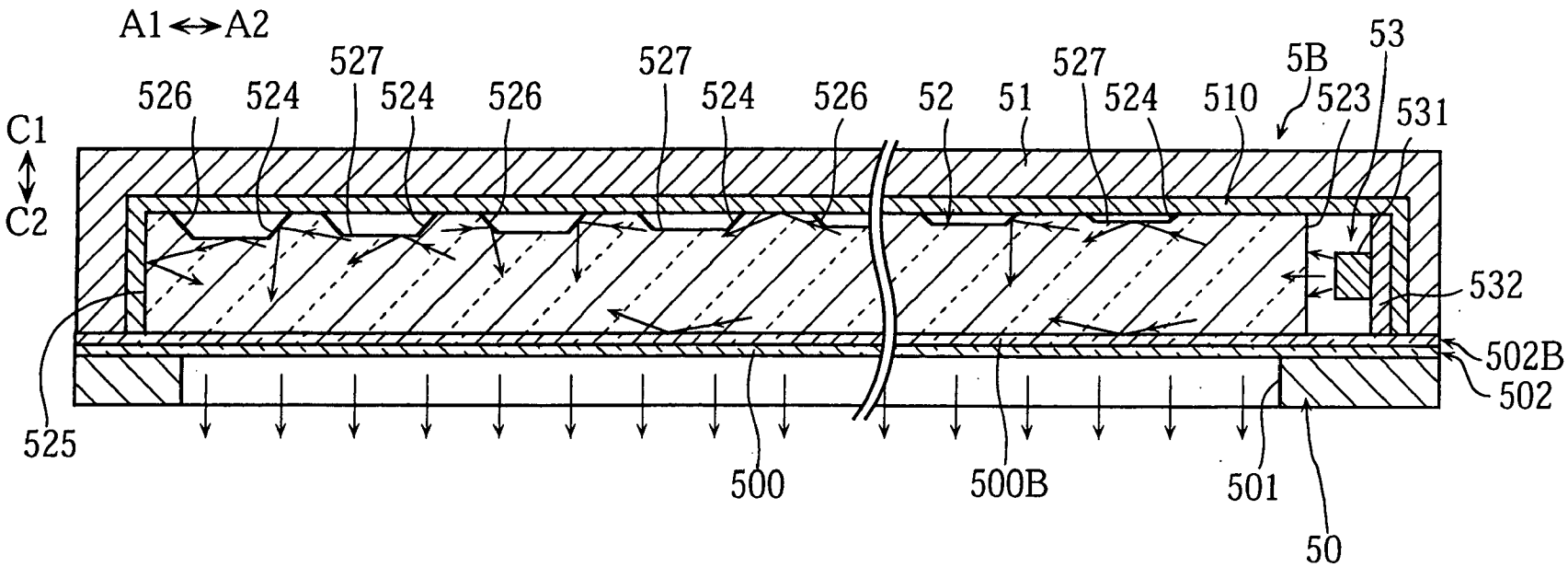
FIG. 11 is a sectional view of the illuminator shown in FIG. 10.

FIGS. 10–11 illustrate a modified illuminator used for the printhead of the present invention. The illustrated illuminator 5B differs from the above-described illuminator 5 in being provided with two light collecting means (a first light collecting means 502 and a second collecting means 502B), but has the same structure in the other respects.

The second light collecting means 502B comprises a luminance improving sheet 500B which is identical to the above luminance improving sheet 500. Specifically, the luminance improving sheet 500B includes a prism layer 512 which is formed with a plurality of ridges 511 arranged parallel to each other, and a base layer 513. As shown in FIG.

10, the second luminance improving sheet 500B is laminated on the first luminance improving sheet 500, whereby the ridges 511 of the second sheet 500B extend longitudinally in the secondary scanning direction.

Figure 12:
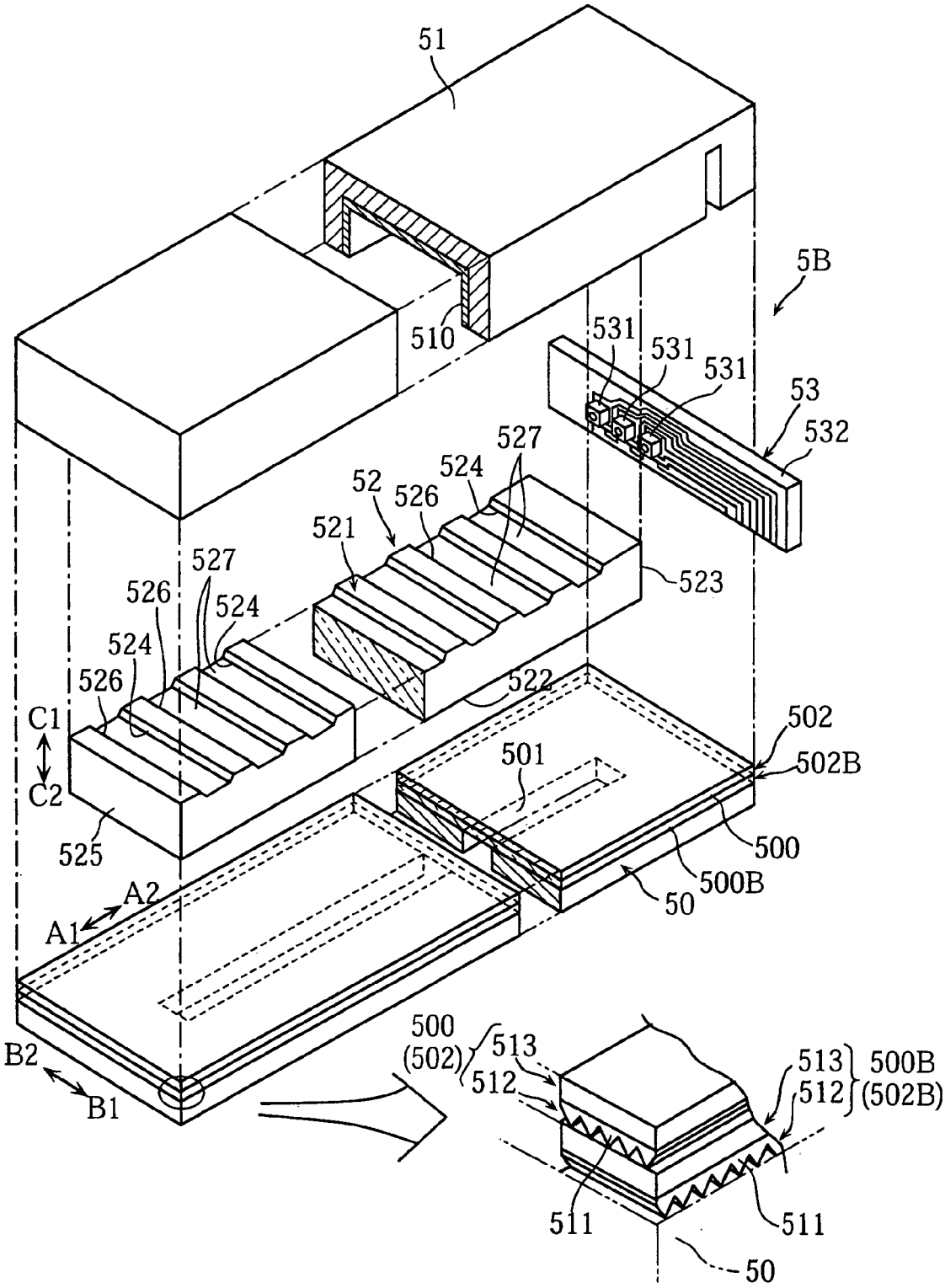
FIG. 12 is an exploded perspective view illustrating another example of illuminator used for the optical printhead.

With the above arrangement, the diffused light emitted from the light emitting surface of the light guide 52 can be collected in both the primary scanning direction and the secondary scanning direction. Though the second sheet 500B is laminated on the first sheet 500 in the example illustrated in FIG. 10, the reverse arrangement may be possible. Specifically, the first sheet 500 may be laminated on the second sheet 500B, as shown in FIG. 12.

The luminance improving sheet 500 (and the additional luminance improving sheet 500B) contributes to efficient use of the light emitted from the light source. In order to demonstrate this effect, five illuminators (examples 1–4 and a comparative example 5) were made as described below for a luminance test.

EXAMPLE 1

The inner surface of the first light shield 50 was white-colored, and the inner surface of the second light shield 51 was entirely covered with a mirror reflector 510. A luminance improving sheet 500 was provided between the first light shield 50 and the light guide 52.

EXAMPLE 2

The inner surface of the first light shield 50 was white-colored, and the inner surface of the second light shield 51 was entirely covered with a mirror reflector 510. Luminance improving sheets 500 and 500B were provided between the first light shield 50 and the light guide 52.

EXAMPLE 3

The inner surfaces of the first and the second light shields 50, 51 were white-colored, and a luminance improving sheet 500 was provided between the first light shield 50 and the light guide 52.

EXAMPLE 4

The inner surfaces of the first and the second light shields 50, 51 were white-colored, and luminance improving sheets 500 and 500B were provided between the first light shield 50 and the light guide 52.

COMPARATIVE EXAMPLE

The inner surfaces of the first and the second light shields 50, 51 were white-colored. Neither of the luminance improving sheets 500, 500*b* were provided between the first light shield 50 and the light guide 52.

Test Procedure: Each of the above-specified illuminators was caused to emit a linear light ray. Measurement of luminance (unit: cd/m$^2$) at predetermined seven points aligned on a center line of the irradiated linear area was made, and the average value Ta of the measurements was calculated.

The result of the above test is shown in table 1. Note that the luminance improving rate in Table 1 is calculated by dividing Ta of four Examples by Ta of the comparative example.

TABLE 1

| | Ta | Luminance Improving Rate |
|---|---|---|
| Example 1 | 861.1 | 2.2 |
| Example 2 | 1065.0 | 2.7 |
| Example 3 | 692.0 | 1.7 |
| Example 4 | 762.3 | 1.9 |
| Comparative Example | 398.1 | — |

As shown in table 1, Examples 1–4 show luminance improving rates higher than Comparative example, meaning that the illumination efficiency is improved.

As described above, according to the present invention, light emitted from light source can be used efficiently. If efficiency in use of the light is raised, enough amount of light for developing photosensitive films can be emitted from a low-power light source. As a result, power consumption of an illuminator and of a printhead can be reduced.

The present invention being thus described, it is obvious that the same may be modified in various ways. Such modifications should not be regarded as a departure from the spirit and scope of the invention, and all such modifications as would be obvious to those skilled in the art are intended to be included in the scope of the appended claims.

The invention claimed is:

1. An optical printhead comprising:

a light source;

a light guide including a light incident surface facing the light source and a flat light emitting surface extending in a primary scanning direction; and a light collecting layer facing the light emitting surface and transmitting light emitted from the light emitting surface;

wherein the light collecting layer causes diffused light from the light emitting surface to be collected in a normal direction of the light emitting surface; and wherein the light guide includes a counter surface extending in the primary scanning direction and arranged opposite to the light emitting surface, the counter surface being provided with a plurality of grooves spaced from each other in the primary scanning direction, each of the grooves including inclined surfaces for reflecting light traveling in the light guide so that the light is directed toward the light emitting surface, the grooves becoming progressively shallower toward the light source.

2. The optical printhead according to claim 1, further comprising a mirror reflector covering the counter surface.

3. The optical printhead according to claim 1, wherein the light collecting layer comprises a first prism layer provided with a plurality of ridges extending parallel to each other.

4. The optical printhead according to claim 3, wherein each of the ridges includes a triangular section.

5. The optical printhead according to claim 3, wherein each of the ridges extends parallel to the primary scanning direction.

6. The optical printhead according to claim 3, further comprising a second prism layer cooperating wit the first prism layer for collecting light, wherein the second prism layer is provided with a plurality of ridges extending parallel to each other, each of the ridges of the second prism layer extending across the ridges of the first prism layer.

7. The optical printhead according to claim 6, wherein each of the ridges of the second prism layer includes a triangular section.

8. The optical printhead according to claim 1, further comprising a liquid crystal shutter facing the light emitting surface of the light guide via the light collecting layer, wherein the liquid crystal shutter comprises a plurality of shutter portions arranged in a row extending in the primary scanning direction.

9. An image forming apparatus comprising:

an optical printhead according to claim 1; and a photosensitive recording medium irradiated by the optical printhead.

10. An optical printhead comprising:

a light source;

a light guide including a light incident surface facing the light source and a flat light emitting surface extending in a primary scanning direction;

a light collecting layer facing the light emitting surface and transmitting light emitted from the light emitting surface;

a lens array for transmitting light from the light collecting layer; and a prism for directing light from the lens array toward a photosensitive recording medium, the prism including a light emitting surface;

wherein the light collecting layer causes diffused light from the light emitting surface of the light guide to be collected in a normal direction of the light emitting surface of the light guide; and wherein the light emitting surface of the prism includes a recess and protrusions, the light emitting surface of the prism contacting the photosensitive recording medium only at the protrusions.

11. An optical printhead comprising:

a light source;

a light guide including a light incident surface facing the light source and a flat light emitting surface extending in a primary scanning direction;

a light collecting layer facing the light emitting surface and transmitting light emitted from the light emitting surface;

a lens array for transmitting light from the light collecting layer, the lens array including a plurality of lenses retained by a lens holder; and a prism for directing light from the lens array toward a photosensitive recording medium, the prism including a light incident surface held in contact with the lens bolder of the lens array;

wherein the light collecting layer causes diffused light from the light emitting surface of the light guide to be collected, in a normal direction of the light emitting surface of the light guide; and wherein the light incident surface of the prism includes a recess facing and spaced from the lenses of the lens array.

* * * * *